US005975398A

United States Patent [19]

Evans

[11] Patent Number: 5,975,398

[45] Date of Patent: Nov. 2, 1999

[54] BUTTON ATTACHING SYSTEM

[76] Inventor: Paul A. Evans, 380A Davenport Rd., Ground Floor, Toronto, Ontario, Canada, M4V 1B4

[21] Appl. No.: 09/026,812

[22] Filed: Feb. 19, 1998

[51] Int. Cl.[6] ..... B65C 7/00

[52] U.S. Cl. ..... 227/67; 227/71

[58] Field of Search ..... 227/67, 68, 134, 227/71

[56] References Cited

U.S. PATENT DOCUMENTS

| | | | |
|---|---|---|---|
| 285,782 | 10/1883 | Atwood | 227/67 |
| 1,343,289 | 6/1920 | Suchy | 227/71 |
| 2,069,878 | 2/1937 | Flood | 227/67 |
| 3,470,834 | 10/1969 | Bone | 227/67 |
| 3,815,798 | 6/1974 | Lavitch | 227/67 |
| 3,900,925 | 8/1975 | La Torraca | 227/67 |
| 4,361,101 | 11/1982 | Marsh | 227/68 |
| 5,482,196 | 1/1996 | Doyel | 227/67 |
| 5,495,974 | 3/1996 | Deschenes | 227/67 |
| 5,755,371 | 5/1998 | Huang | 227/71 |

*Primary Examiner*—Peter Vo
*Assistant Examiner*—James P Calve

[57] ABSTRACT

A button attaching system for securing buttons to clothing by utilizing an I-shaped fastener projecting through the button and the clothing without requiring additional sewing equipment. The system includes a plunging structure, a plunger member slidably movable in the interior of the plunging structure, a hollow needle shaft attached to the plunging structure, and an I-shaped connector securing a button to clothing.

4 Claims, 3 Drawing Sheets

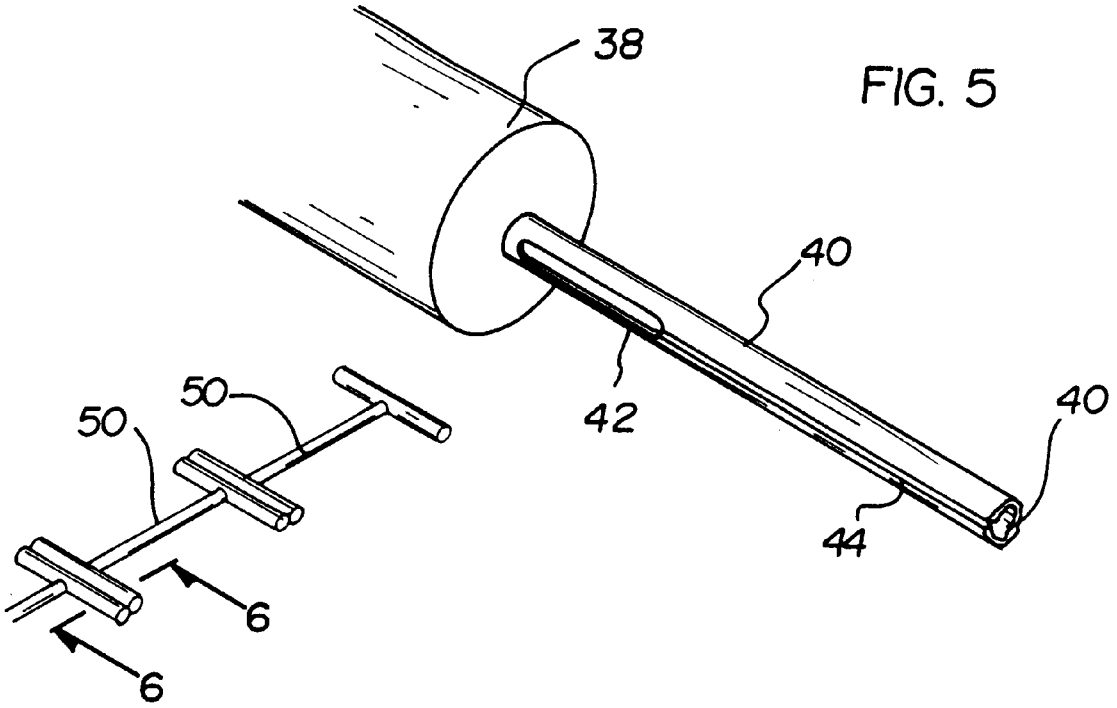
FIG. 5
FIG. 6
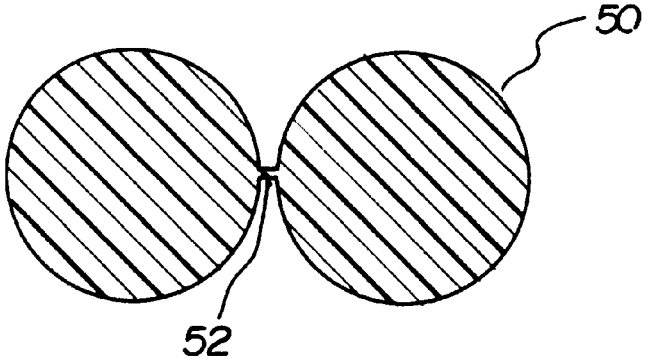

BUTTON ATTACHING SYSTEM

BACKGROUND OF THE INVENTION

1. Field of the Invention

The present invention relates to Button Attaching Devices and more particularly pertains to a new Button Attaching System for securing buttons to clothing by utilizing an I-shaped fastener projecting through the button and the clothing without requiring additional sewing equipment.

2. Description of the Prior Art

The use of Button Attaching Devices is known in the prior art. More specifically, Button Attaching Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Button Attaching Devices include U.S. Pat. No. 5,379,888; U.S. Pat. No. 5,263,627; U.S. Pat. No. 4,773,343; U.S. Pat. No. 4,813,110; U.S. Pat. No. 4,841,604 and U.S. Pat. No. 5,189,762.

While these devices fulfill their respective, particular objectives and requirements, the aforementioned patents do not disclose a new Button Attaching System. The inventive device includes a plunging structure, a plunging means slidably secured to the interior of the plunging structure, a hollow needle shaft attached to the plunging means, and an I-shaped connector securing a button to clothing.

In these respects, the Button Attaching System according to the present invention substantially departs from the conventional concepts and designs of the prior art, and in so doing provides an apparatus primarily developed for the purpose of securing buttons to clothing by utilizing an I-shaped fastener projecting through the button and the clothing without requiring additional sewing equipment.

SUMMARY OF THE INVENTION

In view of the foregoing disadvantages inherent in the known types of Button Attaching Devices now present in the prior art, the present invention provides a new Button Attaching System construction wherein the same can be utilized for securing buttons to clothing by utilizing an I-shaped fastener projecting through the button and the clothing without requiring additional sewing equipment. The general purpose of the present invention, which will be described subsequently in greater detail, is to provide a new Button Attaching System apparatus and method which has many of the advantages of the Button Attaching Devices mentioned heretofore and many novel features that result in a new Button Attaching System which is not anticipated, rendered obvious, suggested, or even implied by any of the prior art Button Attaching Devices, either alone or in any combination thereof.

To attain this, the present invention generally comprises a plunging structure, a plunging means slidably secured to the interior of the plunging structure, a hollow needle shaft attached to the plunging means, and an I-shaped connector securing a button to clothing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Button Attaching System apparatus and method which has many of the advantages of the Button Attaching Devices mentioned heretofore and many novel features that result in a new Button Attaching System which is not anticipated, rendered obvious, suggested, or even implied by any of the prior art Button Attaching Devices, either alone or in any combination thereof.

It is another object of the present invention to provide a new Button Attaching System which may be easily and efficiently manufactured and marketed.

It is a further object of the present invention to provide a new Button Attaching System which is of a durable and reliable construction.

An even further object of the present invention is to provide a new Button Attaching System which is susceptible of a low cost of manufacture with regard to both materials and labor, and which accordingly is then susceptible of low prices of sale to the consuming public, thereby making such Button Attaching System economically available to the buying public.

Still yet another object of the present invention is to provide a new Button Attaching System which provides in the apparatuses and methods of the prior art some of the advantages thereof, while simultaneously overcoming some of the disadvantages normally associated therewith.

Still another object of the present invention is to provide a new Button Attaching System for securing buttons to clothing by utilizing an I-shaped fastener projecting through the button and the clothing without requiring additional sewing equipment.

Yet another object of the present invention is to provide a new Button Attaching System which includes a plunging structure, a plunging means slidably secured to the interior of the plunging structure, a hollow needle shaft attached to the plunging means, and an I-shaped connector securing a button to clothing.

Even still another object of the present invention is to provide a new Button Attaching System wherein the user is able to utilize the invention on the spot when a button falls off without requiring additional sewing equipment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred imbodiments of the invention.

DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front upper perspective view of the present invention.

FIG. 6 is a cross sectional view taken along line 6—6 of FIG. 5.

DESCRIPTION OF THE PREFERRED EMBODIMENT

Figure 2:
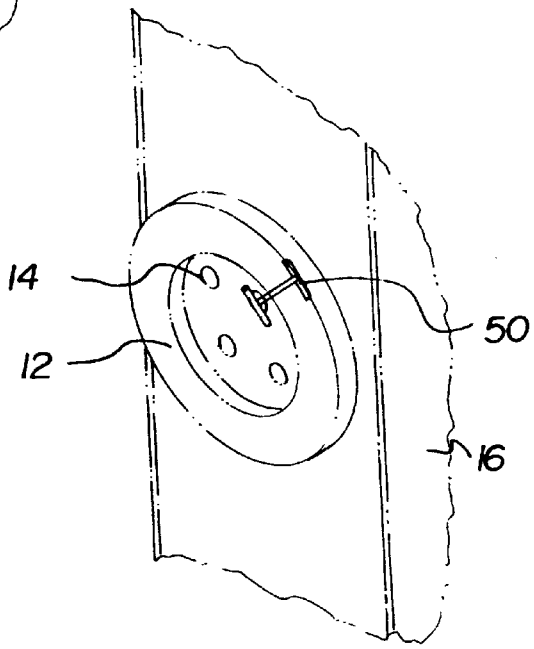
FIG. 2 is a front perspective view of a button member secured to clothing material.
Figure 1:
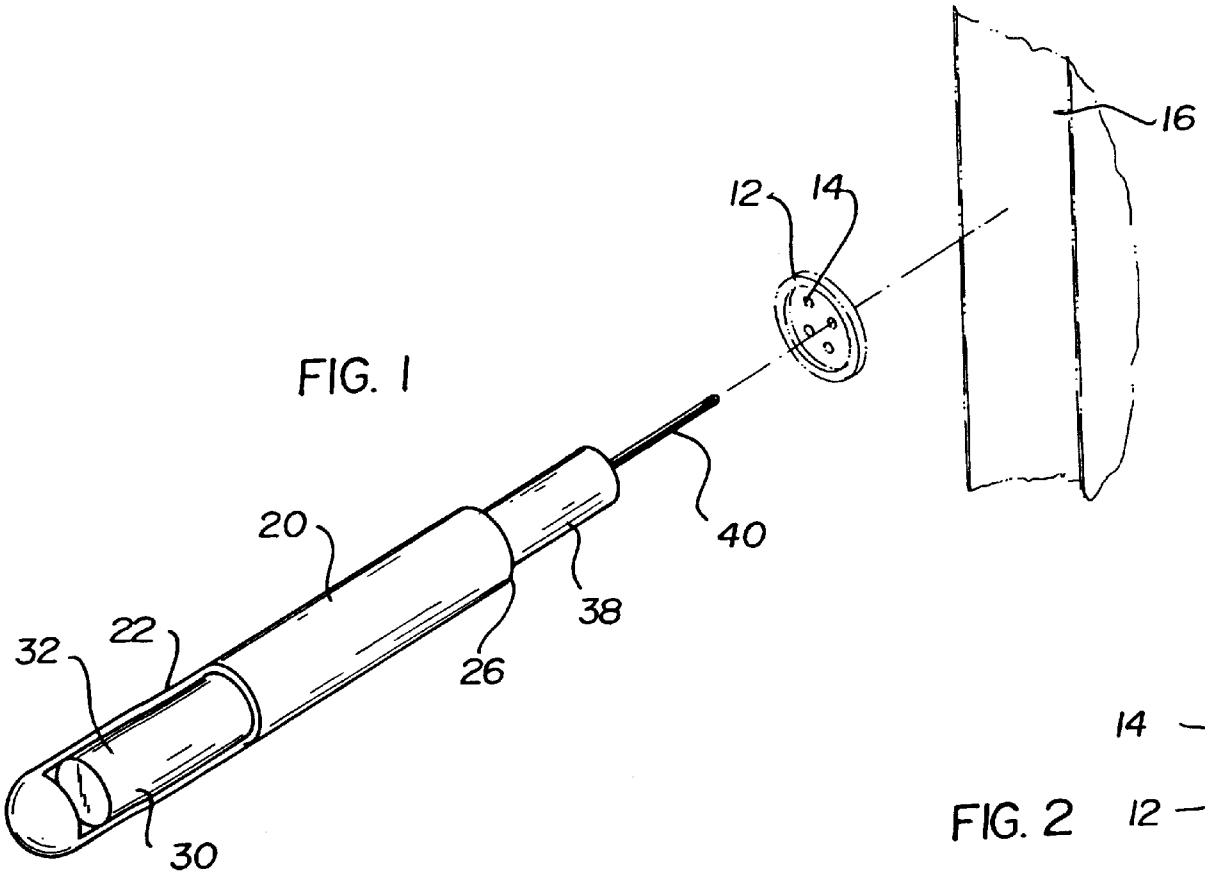
FIG. 1 is an rear upper perspective view of a new Button Attaching System according to the present invention.
Figure 3:
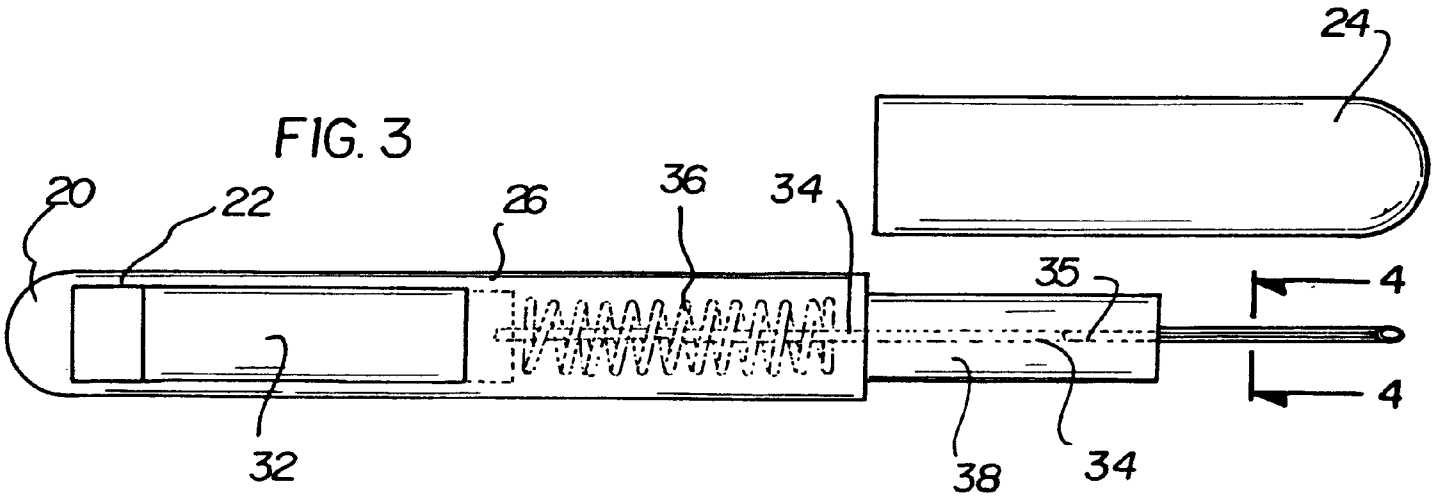
FIG. 3 is a side view of the present invention.
Figure 4:
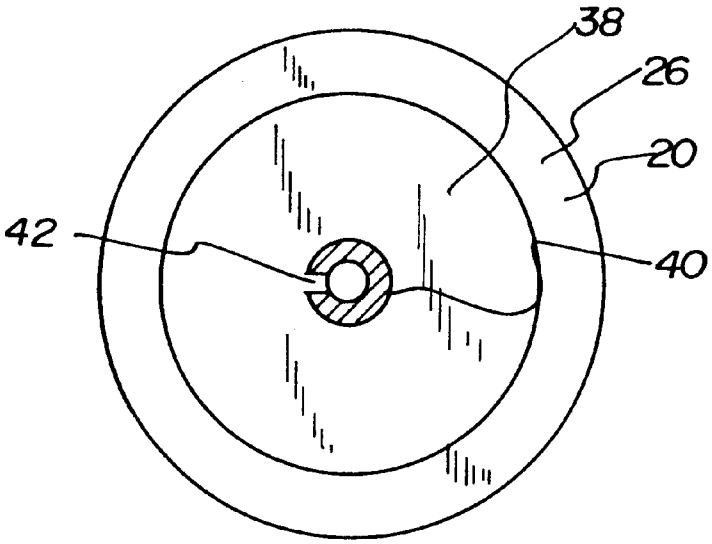
FIG. 4 is a cross sectional view taken along line 4—4 of FIG. 3.

With reference now to the drawings, and in particular to FIGS. 1 through 6 thereof, a new Button Attaching System embodying the principles and concepts of the present invention and generally designated by the reference numeral 10 will be described.

More specifically, it will be noted that the Button Attaching System 10 comprises a plunging structure 20, a plunging means 30 slidably secured within the plunging structure 20, a hollow needle shaft 40 is attached to the plunging means 30, a button member 12 where the hollow needle shaft 40 projects through a button aperture 14, a clothing material 16 is pierced by the hollow needle shaft 40, and at least one I-shaped fastener 50 which projects through the hollow needle shaft 40 securing the button member 12 to the clothing material 16.

As best illustrated in FIGS. 1 through 6, it can be shown that a hollow encasing handle 26 includes a finger engaging slot 22 allowing the user to insert a finger for manual manipulation of the present invention. A safety cap member 24 abuts the hollow encasing handle 26 opposite of the finger engaging slot 22 protecting the user from the hollow needle shaft 40 when the invention is not in use. A plunger member 32 is slidably positioned within the hollow encasing handle 26 with one end engaging a push rod 34. The push rod 34 projects through a push rod passage 35 inside a needle support shaft 38 which is secured to the hollow encasing handle 26 opposite of the finger engaging slot 22. The plunger member 32 engages a retraction spring 36 where the opposite end of the retraction spring 36 engages the needle support shaft 38 opposite of the hollow needle shaft 40. The hollow needle shaft 40 is secured to the end of the needle support shaft 38 opposite of the retraction spring 36 and includes a fastener insertion slot 42 allowing the user to insert the I-shaped fastener 50. A guiding slot 44 extends from the fastener insertion slot 42 to the tip of the hollow needle shaft 40 opposite of the needle support shaft 38 guiding the I-shaped fastener 50 into the clothing material 16. The I-shaped fastener 50 includes a connecting member 52 which connects at least two I-shaped fasteners 50 together for handling purposes.

In use, the user partially inserts the I-shaped fastener 50 into the fastener insertion slot 42 and inserts the hollow needle shaft 40 through the button aperture 14 and further through the clothing material. The user then inserts a finger into the finger engaging slot 22 engaging an end of the plunger member 32 which further engages the push rod 34. The user pushes the plunger member 32 projecting the push rod 34 which engages the I-shaped fastener 50 and further compressing the retraction spring 36. The I-shaped fastener 50 is projected through the hollow needle shaft 40 aligned by the guiding slot 44 where one end of the I-shaped fastener 50 is projected through the button aperture 14 and further through the clothing material 16. The retraction spring 35 retracts the push rod 34. The I-shaped fastener 50 secures the button member 12 to the clothing material 16 by the projected end becoming parallel to the interior surface of the clothing material 16 and the end of the I-shaped fastener 50 opposite of the projected end becoming parallel to the face of the button member 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A button attaching system comprising:

a substantially tubular plunging structure forming an elongate handle having a substantially cylindrical exterior and a substantially hollow interior, the elongate handle having a closed end;

a plunger member with a first and a second end slidably movable in the interior of the elongate handle;

a tubular needle shaft attached to an end of the plunging structure opposite the closed end, the tubular needle shaft being substantially coaxial with the substantially cylindrical exterior of the elongate handle, the tubular needle shaft having a free end with a tip, the free end being adapted for projecting through a button aperture in a button member and piercing through a clothing material, the tip of the free end of the tubular needle shaft having an opening coaxial with the interior of the needle shaft;

a push rod mounted to the first end of the plunger member, the push rod being slidably movable in the interior of the tubular needle shaft;

a retraction spring mounted in the interior of the elongate handle for biasing the plunger member toward the substantially closed end of the elongate handle such that the push rod is biased away from the free end of the tubular needle shaft; and at least one I-shaped fastener which secures the button member to the clothing material;

wherein the elongate handle has a finger access slot exposing the second end of the plunger member to an exterior of the elongate handle for permitting a finger of a user to be inserted through the finger access slot and to engage the second end of the plunger member for moving the plunger member in the interior of the handle;

wherein the tubular needle shaft includes a fastener insertion slot extending into the interior of the needle shaft for receiving a transverse end bar of the I-shaped fastener, and the tubular needle shaft having a guiding slot in communication with the fastener insertion slot and extending to the tip of the tubular needle shaft, the guiding slot further being in communication with the opening in the tip of the tubular needle shaft.

2. The button attaching system of claim 1, additionally comprising an elongate cylindrical safety cap member with a closed end and an open end for receiving the tubular needle shaft for protecting the tubular needle shaft when not in use.

3. The button attaching system of claim 1, additionally comprising a needle support shaft secured to the elongate handle opposite of the closed end of the handle, the tubular needle shaft being mounted to the needle support shaft, the needle support shaft having a push rod passage therein, the push rod extending through the push rod passage.

4. The button attaching system of claim 1 additionally comprising a plurality of interlinked I-shaped fasteners, each of the I-shaped fastener includes a connecting member which connects the transverse end bars of adjacent I-shaped fasteners together to form a chain of interlinked I-shaped fasteners.

* * * * *